US005316295A

United States Patent [19]

Costanzo

[11] Patent Number: 5,316,295

[45] Date of Patent: May 31, 1994

[54] METHOD AND APPARATUS FOR DAMPENING RACQUET VIBRATION

[76] Inventor: Raphael J. Costanzo, 63 Senior Dr., Monroe, Conn. 06468

[21] Appl. No.: 34,427

[22] Filed: Mar. 19, 1993

[51] Int. Cl.[5] ..... A63B 49/00

[52] U.S. Cl. ..... 273/73 R; 273/73 G

[58] Field of Search ..... 273/73 R, 73 G, 73 J, 273/75, 81 R, 81 D

[56] References Cited

U.S. PATENT DOCUMENTS

| | | | |
|---|---|---|---|
| 4,347,280 | 8/1982 | Lau et al. | 273/75 X |
| 5,039,096 | 8/1991 | Chen | 273/73 G |
| 5,122,405 | 6/1992 | Landi | 273/73 G X |
| 5,134,008 | 7/1992 | Alm | 273/73 J X |

FOREIGN PATENT DOCUMENTS

| | | | |
|---|---|---|---|
| 2593072 | 7/1987 | France | 273/73 R |

*Primary Examiner*—Vincent Millin
*Assistant Examiner*—Raleigh W. Chiu
*Attorney, Agent, or Firm*—Arthur T. Fattibene; Paul A. Fattibene

[57] ABSTRACT

A racquet and method of forming the same having a head frame and a handle connected thereto defining a junction about which a resilient band is tightly secured thereto by shrinking the band to conform to the shape of the junction so as to absorb the vibratory moment imparted to the head frame upon impact with a ball.

11 Claims, 2 Drawing Sheets

METHOD AND APPARATUS FOR DAMPENING RACQUET VIBRATION

FIELD OF INVENTION

This invention is directed to a racquet for use in the play of tennis, racquet ball, squash and the like. More specifically, this invention is directed to a method and apparatus or means for dampening the vibratory motion imparted to the racquet caused upon impact with a ball during the play of a game.

PROBLEM AND PRIOR ART

Heretofore, racquets used in the play of tennis, racquet ball, squash and the like generally consisted of a frame head to which the strings are laced and a connected handle. Generally, the handle is connected to the head frame by a junction which may be defined as a yoke that converges into the opposite sides of the head frame. Players of such games as tennis, racquet ball, squash and the like are known to frequently develop injuries often referred to as "tennis elbow" or "tennis shoulder." These are very painful injuries which frequently hinder a player to such an extent that the player loses his effectiveness, and when severe enough, requires the player to cease playing the game for extended periods of time. Players can be sidelined for considerable periods of time because of such injuries. To avoid such "tennis elbow" type injuries or soreness, many tennis players have resorted to the use of "wrist straps" or elbow braces or bands in an effort to reduce the effects of tennis elbow injuries. It was thought that the use of such wrist bands and elbow bands would strengthen the player's hands and arms and thereby minimize the effects caused by the racquet striking the ball; frequently with tremendous velocities. Depending upon the efficiency and/or a particular player's ability, the impact of a racquet against a ball can be enormous. Players have been known to propel a tennis ball or racquet ball at speeds of 90 or more miles per hour. Such impact places enormous forces on the arms of a player, to frequently result in the so-called "tennis elbow" type injuries.

It has been observed and noted that the racquet is shaped and functions, when impacted by a tennis ball, as a tuning fork. That is, each time the racquet strikes the ball, a tuning fork high frequency vibration is imparted to the racquet which travels down through the handle and into the player's wrist, arms and elbow. It is believed that the high frequency vibration imparted to the racquet each time it strike the ball is a large contributing factor for so-called "tennis elbow" injuries. To minimize resulting "tennis elbow" type injuries, it is imperative to reduce or dampen the vibratory motion imparted to the racquet each time the ball is hit. The known racquets are not now provided with means to dampen or minimize the vibratory or high frequency vibrations produced on impact with a ball during the play of the game.

This invention is therefore directed to a particular method and means for reducing "tennis elbow" type of injuries by minimizing o eliminating the racquet vibrations produced upon impact with a ball.

SUMMARY OF THE INVENTION

The object of this invention is achieved by providing a racquet with a band or sleeve circumscribing the juncture between the head frame and handle which is capable of absorbing or dampening the vibratory motion imparted to the head frame so as to prevent such motion from traveling down the handle and into the arm of the player. This is attained by forming a band or sleeve of a resilient rubber or rubber-like material arranged to be fitted about the juncture or yoke by which the handle of the racquet connects to the head frame. The rubber-like band or sleeve is tightly fitted to the handle junction or yoke by which the handle of the racquet connects to the head frame. The rubber-like band or sleeve is tightly fitted to the handle junction so as to dampen the vibratory motion imparted to the head frame. Because of the impact and speed to which such racquets are subjected, the dampening sleeve must be firmly secured to prevent dislodging during play. This can be attained by suitable fastening means or by forming the sleeve or band of a shrinkable material which can be shrunk in place about the handle junction. In an alternate arrangement, a heat shrinkable band is superposed over the dampening band or sleeve, and heat shrunk to tightly secure the dampening band or sleeve in place about the handle yoke. With such dampening sleeve secured to the handle junction, it will be apparent that the vibratory motion imparted to the head frame will be greatly dampened before the motion is permitted to travel down the handle.

Figure 2:
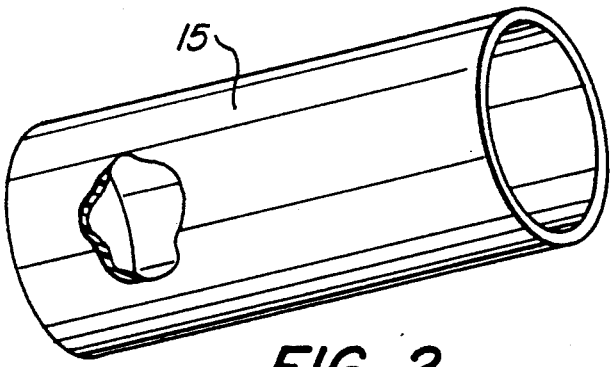
FIG. 2 is a detail perspective view of the dampening band or sleeve.
Figure 1:
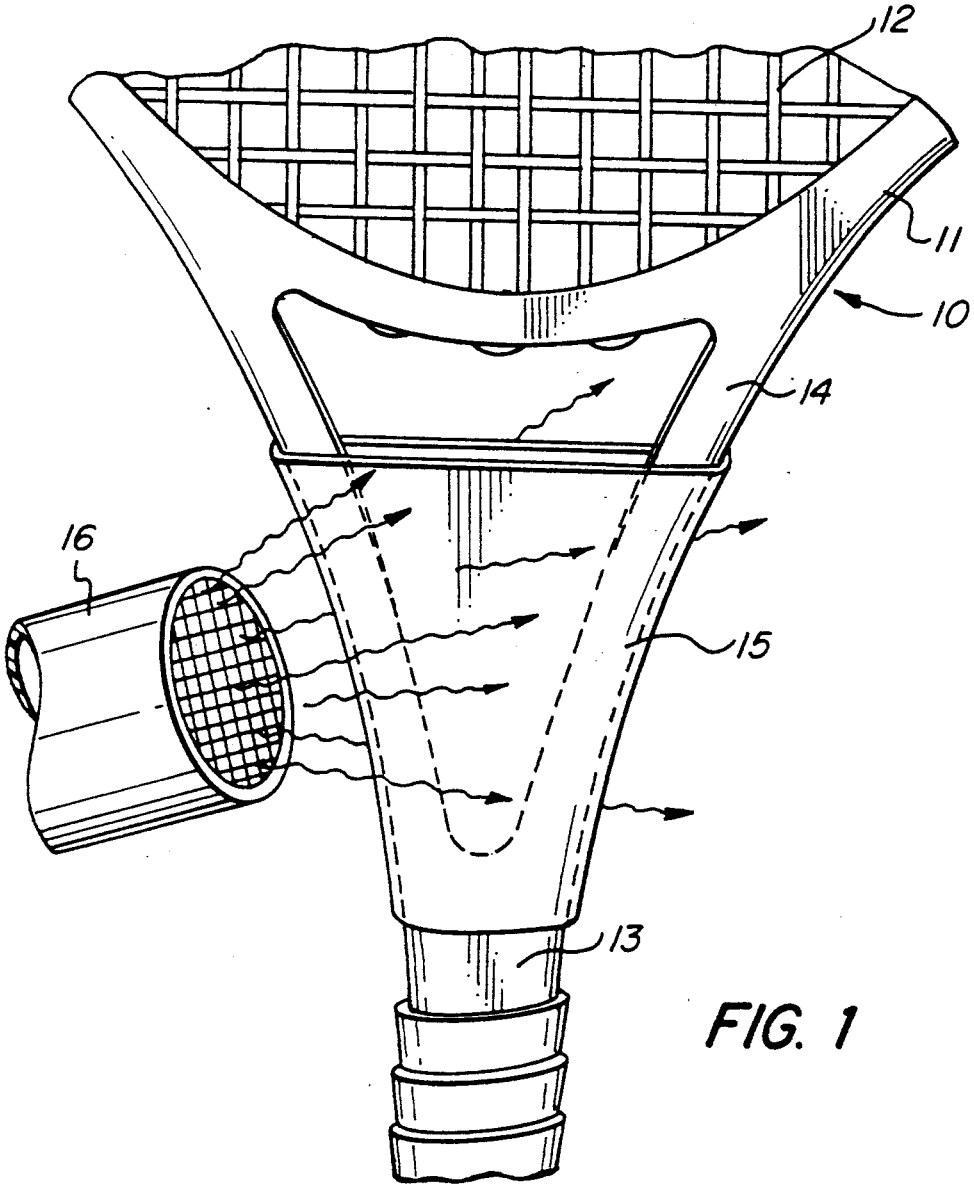
FIG. 1 illustrates a fragmentary plan view of a racquet showing the dampening band or sleeve being secured in place about the handle junction of the racquet.

DETAILED SPECIFICATION:

Referring to FIG. 1, there is illustrated a racquet 10 of conventional construction consisting of a head frame 11, shown in part to which the strings 12 are interlaced and a connected handle 13. In the illustrated embodiment, the handle 13 is connected to the head frame 11 by a yoke type junction 14. Each side of the yoke junction 14 flares outwardly and merges into the opposed sides of the head frame which is generally elliptical in shape, analogous to a tuning fork. Each time that the head of the racquet strikes a ball, a force is transmitted to the head frame to impart a vibratory motion or frequency thereto somewhat analogous to a tuning fork, which travels down the handle and unknowingly into the hands and arms of the player holding the racquet.

To prevent the vibratory motion imparted to the head frame upon high impact with a ball, a means is provided to dampen the vibratory motion of the racquet. In the illustrated embodiment of FIG. 1, the dampening means comprises a band or sleeve 15 which is slid over the handle 13 and stretched over the yoke or handle junction 14. The sleeve or band is formed of a resilient rubber or rubber-like plastic material which is capable of being stretched to conform to the shape of the yoke or junction 14. The arrangement is such that the band or sleeve is tightly stretched and secured in place so as to prevent any slippage or dislodgement during play. It is imperative that the dampening sleeve or band be secured to the handle junction so as to prohibit that vibratory motion or frequency from being transmitted to the handle. While the band or sleeve 15 may be secured by suitable fasteners or adhesives in the illustrated embodiment, the band or sleeve is formed of a resilient material which can also be shrunk. With such a band or sleeve 15, the same can be firmly secured to the handle junction 14 by shrinking the sleeve or band. This can be readily attained by applying heat, e.g. the heat of a conventional hair dryer 16 to a dampening band or sleeve 15 to shrink the band or sleeve 15 to conform tightly to the shape of the junction 14. In this manner, the dampening sleeve 15 can be readily sold as an add-on part which the player himself can purchase separately and easily apply to his own standard racquet. Alternatively, the original manufacturer of the racquet can apply the dampening sleeve as original equipment in a very simple and expedient manner. It is important that the dampening sleeve or band 15 tightly embrace the handle junction 14. This can be best achieved by heat shrinking the band or sleeve 15 to the handle junction 14.

Figure 4:
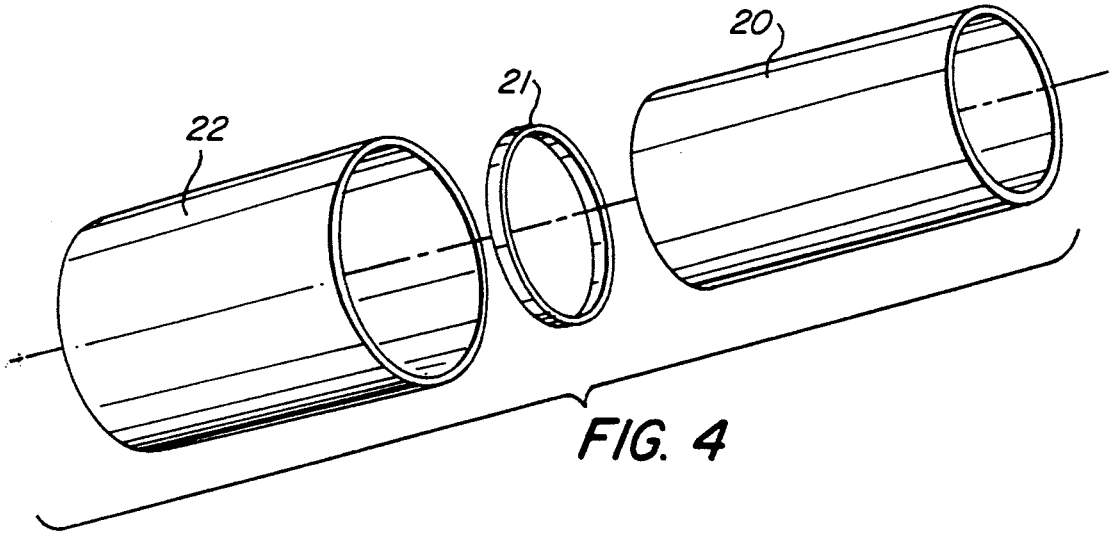
FIG. 4 is a detail perspective exploded view of the modified embodiment of dampening means of FIG. 3.
Figure 3:
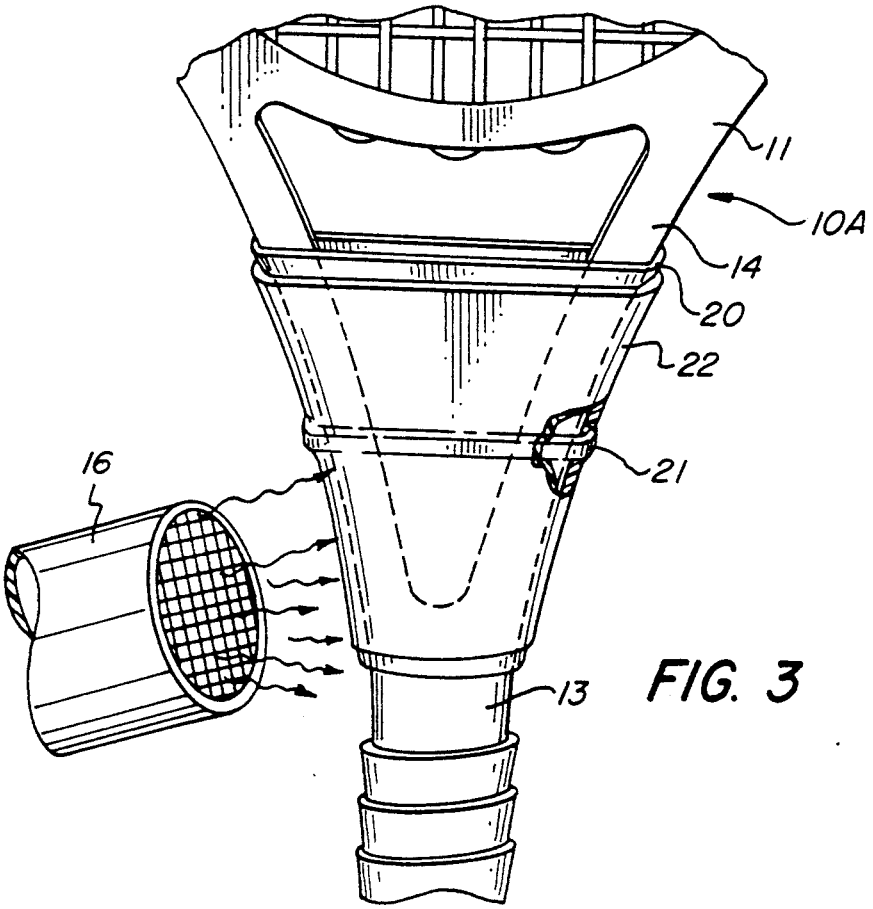
FIG. 3 is a view similar to that of FIG. 1 but illustrating another embodiment of the invention.

FIGS. 3 and 4 illustrate another embodiment of the invention. The illustrated racquet 10A is similar to that describe with respect to FIG. 1. In this embodiment, the dampening means comprises a dampening sleeve 20 formed of a resilient and/or stretchable material formed of rubber or rubber-like plastic capable of absorbing the vibration imparted to the head frame upon impact with a ball during the play of the game.

The sleeve 20 is fitted over the yoke or handle connection 14. As seen in FIG. 3, the sleeve 20 is stretched over the yoke to define a flat oval similar to the sleeve illustrated in FIG. 1. Sleeve 20 is sufficiently thick so as to absorb or dampen the shock or vibration imparted to the head frame il upon striking a ball. To secure the band or sleeve 20 and to prevent slippage, an elastic holding band 21 is provided. Superimposed over the dampening band or sleeve 20 and holding band 21 is a second sleeve 22 which is formed of a suitable heat shrinkable plastic material. The heat shrinkable sleeve 22 is originally sized so that it can be slipped over and circumscribe the dampening sleeve 20 as best shown in FIG. 3. To secure the respective sleeve 20 and 22 to the handle junction 14, heat is applied to the outer or second sleeve 22. The heat of a conventional hair dryer has been noted to be sufficient to effect the shrinking of the second sleeve 22. Upon shrinking, sleeve 22 firmly secures the dampening sleeve 20 tightly about the handle junction. The respective sleeves 20 and 22 are thus so tightly bound to the handle junction that they will not dislodge during play. In effect, they become virtually an integral part of the racquet.

With the dampening sleeve tightly in place about the handle junction, it will be apparent that the vibration imparted to the head frame will be dampened or diminished before traveling down the handle 13 of the racquet and to the hand and arm of the player.

By prohibiting or minimizing the amount of vibration transmitted to the hand and arm of a player, the incidence of tennis elbow can be substantially diminished. Thus, the need for wrist and elbow supports can be avoided.

While the invention has been described with respect to particular embodiments thereof, it will be understood and appreciated that variations and modifications may be made without departing from the spirit or scope of the invention.

What is claimed is:

1. A method of dampening the vibration of a stringed racquet during the play of a game requiring a racquet wherein the racquet includes a head frame and a handle connected thereto, comprising the steps of:

forming a band of a resilient material of sufficient thickness to absorb the vibratory motion imparted to said head frame upon impact with a ball during the play of the game, placing said band of resilient material about the junction at which the racquet handle connects to the head frame, tightly securing said band to conform to the shape of said junction, and shrinking said band onto said junction for tightly securing said band to said junction.

2. The method as defined in claim 1 and including the step of:

applying heat to said band of resilient material to effect the shrinking thereof for tightly securing said band to said junction.

3. A method of dampening the vibration of a stringed racquet during the play of a game wherein the racquet includes a head frame and a handle connected thereto comprising the steps of:

placing a sleeve of a resilient material about the junction at which the racquet handle connects to the head frame, applying a second sleeve formed of a heat shrinkable material so as to overlap said first mentioned resilient sleeve, and shrinking said second sleeve for tightly securing said resilient sleeve about the handle junction of said racquet.

4. A method as defined in claim 3 and including the step of securing said first mentioned sleeve about said junction with a holding band, and applying heat to said second sleeve for effecting the shrinking thereof.

5. In combination with a stringed racquet having a head frame and a handle connected thereto, a vibration dampening device comprising a band formed of a resilient material capable of absorbing the vibratory motion imparted to said racquet upon impact with a ball during the play of a game, and means for tightly securing said band about the junction connecting said handle to said head frame, wherein said means for tightly securing said band about said junction comprising said band being formed of a heat shrinkable resilient material whereby the band is shrunk about said

6. A racquet comprising:

a head frame, a handle connected to said head frame to form a junction thereat, a band of resilient material tightly circumscribing said junction between said handle and head frame, and said band being formed of a material adapted to absorb and dampen the vibrations imparted to said racquet when impacted with a ball during the play of a game, wherein said band is formed of a shrinkable material which, when fitted to said junction, is secured thereto by shrinking.

7. A racquet comprising:

a head frame, a handle connected to said head frame to form a junction thereat, a band of resilient material tightly circumscribing said junction between said handle and head frame, and said band being formed of a material adapted to absorb and dampen the vibrations imparted to said racquet when impacted with a ball during the play of a game, and including a second band, said second band being arranged to circumscribe said first mentioned band, said second band being formed of a heat shrinkable material which, when shrunk, tightly secures said first mentioned band about said junction.

8. A racquet for use in the play of a game requiring a racquet comprising:

a head frame, a handle connected to said head frame and defining a junction thereat, a sleeve formed of a resilient material circumscribing said junction, a holding hand for holding said sleeve in position about said junction, and a second sleeve circumscribing said first mentioned sleeve and holding band, said second sleeve being formed of a heat shrinkable material which, when shrunk, secures said resilient sleeve about said junction.

9. A dampening device for dampening the vibration imparted to a racquet in striking a ball comprising:

a sleeve of a resilient material capable of absorbing the vibratory motion imparted to a racquet upon impact with a ball, said sleeve being adapted to circumscribe the junction between a frame head and the handle of a racquet, and including a second sleeve, said second sleeve being formed of a shrinkable material, and said second sleeve being sized to circumscribe said first mentioned sleeve whereby said sleeves are adapted to be tightly bonded to the handle junction of a racquet by shrinking said second sleeve.

10. A dampening device as defined in claim 9 wherein said second sleeve is formed of a heat shrinkable material, said second sleeve being shrunk by the application of heat thereto.

11. A method of dampening the vibration of a stringed racquet during the play of a game requiring the use of a racquet wherein the racquet includes a head frame and a handle connected thereto comprising the steps of:

placing a band of resilient material about the junction at which the racquet handle connects to the head frame, forming said band as an endless sleeve formed of a heat shrinkable material which is stretched about said junction, tightly securing said band to conform to the shape of said junction, and applying heat to said band for shrinking said band tightly about said junction.

* * * * *